United States Patent [19]

Young, Jr.

[11] Patent Number: 5,042,121

[45] Date of Patent: Aug. 27, 1991

[54] METHOD AND APPARATUS FOR DECURLING AND TENTERING FABRIC

[75] Inventor: William O. Young, Jr., Spartanburg, S.C.

[73] Assignee: Young Engineering, Inc., Spartanburg, S.C.

[21] Appl. No.: 599,665

[22] Filed: Oct. 18, 1990

Related U.S. Application Data

[63] Continuation of Ser. No. 450,295, Dec. 13, 1989, abandoned, which is a continuation of Ser. No. 107,660, Oct. 13, 1987, abandoned.

[51] Int. Cl.[5] ..... D06C 3/06; D06C 3/08; D06C 3/02; D06C 3/00

[52] U.S. Cl. ..... 26/98; DIG. 1/96; DIG. 1/86; DIG. 1/76

[58] Field of Search ..... 26/76, 86, 96, 98, DIG. 1, 26/78, 88

[56] References Cited

U.S. PATENT DOCUMENTS

| | | | |
|---|---|---|---|
| 1,673,253 | 6/1928 | Krantz | 26/86 |
| 1,773,232 | 8/1930 | Lenders | 26/86 |
| 1,864,681 | 6/1932 | Tandel | 26/76 |
| 2,750,650 | 6/1956 | Laurie | 26/98 |
| 3,936,915 | 2/1976 | Becker | 26/86 |
| 4,447,937 | 5/1984 | Young, Jr. | 26/98 |
| 4,578,845 | 4/1986 | Young, Jr. | 26/98 |

FOREIGN PATENT DOCUMENTS

| | | | |
|---|---|---|---|
| 506952 | 11/1954 | Canada | 26/DIG. 1 |
| 276759 | 7/1914 | Fed. Rep. of Germany | 26/86 |
| 663739 | 8/1938 | Fed. Rep. of Germany | 26/86 |
| 1060344 | 7/1959 | Fed. Rep. of Germany | 26/86 |
| 787823 | 7/1935 | France | 26/86 |
| 117427 | 7/1918 | United Kingdom | 26/DIG. 1 |

*Primary Examiner*—Werner H. Schroeder
*Assistant Examiner*—Bibhu Mohanty
*Attorney, Agent, or Firm*—Dority & Manning

[57] ABSTRACT

A tenter frame for spreading and treating open widths of a moving fabric which includes a pair of endless tenter chains each of which has a plurality of upstanding pins adapted to engage opposed edges of the fabric for transporting the fabric through the tenter through a first generally horizontal plane. A feed roll is provided for guiding the fabric which has an upper periphery located in a second generally horizontal plane which is higher than the horizontal plane of the tenter chain. A static decurling apparatus is disposed along each side of the tenter frame at a point between the ends of the tenter chains and the feed roll and extends in a generally inclined plane which intersects the first plane and the second plane. The decurling apparatus contacts the edges of the moving fabric and removes the curl, folds and the like from the edges for guiding the fabric towards the tenter chains. Nip rolls are provided which have a nip in the horizontal plane of the tenter chain adapted to receive the moving fabric as it traverses through the decurling apparatus for maintianing the fabric edges in a flattened uncurled condition. An arcuate plane is disposed between the decurling apparatus and the nip rolls for generally bridging the distance between the nip rolls and the decurling apparatus.

23 Claims, 3 Drawing Sheets

METHOD AND APPARATUS FOR DECURLING AND TENTERING FABRIC

This is a continuation of application Ser. No. 450,295, filed Dec. 13, 1989, now abandoned, and a continuation of 107,660, filed Oct. 13, 1987, now abandoned.

BACKGROUND OF THE INVENTION

Textile webs or fabrics in general are subject to curling along their edges or selvages while being handled in open width and often develop curls, pressed folds, pleats or creases therealong due to improper handling, improper web tension or the like. Knit or other flimsy textile fabrics, and particularly when they are processed or handled under tension, or in a generally tensionless condition, tend to curl or roll up along the selvage. In order to produce a good quality roll of textile fabric, or to achieve proper fabric handling along a process line for printing, inspection, drying, extraction of moisture, washing, doubling, tacking or other web treatment it is desirable, if not necessary, to ensure that the web is maintained in a flat condition where little or no fabric deformation is present at either of the selvages during the winding or processing as set forth above. When such webs or fabrics are fed to the usual tenter frame, it is necessary to decurl the edges of the fabric before engaging the selvages or the edges thereof with the pins on the tenter frame chain.

In one known tenter frame, the fabric is supplied from a roll of fabric over a feed roll which is on a level or horizontal plane, which is higher than the horizontal plane occupied by the tenter chain on which the fabric must be impinged and engaged. In this device, the selvages of the fabric are engaged by a temple which has a spiral row of teeth or pins and is adapted to spread the edge of the fabric before it enters the area of the tenter chain pin. In order to engage the edge of the fabric upon the pins of the tenter chain, it is necessary that the fabric be directed over the area of the tenter chain pins so that it can be pressed into the pins by a revolving brush or a roll having short bristles thereon which may be penetrated by the pins on the tenter chain. In such devices it is necessary for the edge of the fabric to follow a convoluted path which distorts or stretches the edges of the fabric and applies uneven tension thereon. Such tenters are sold under the trade name, Montex Stenter System by The Consultex Corporation of Spartanburg, S.C. and are manufactured by A. Monforts GmbH & Company Maschinenfabrik of MonchenGladbach in the Federal Republic of Germany.

Other tenters use a static decurling device such as that shown in U.S. Pat. No. 4,578,845, issued Apr. 1, 1986 to William O. Young, Jr. The Young web edge decurler of this patent has been commercially successful and performs the decurling operation in a very simple fashion. However, the decurler of Young is generally supported on the horizontal plane of the tenter rail before the fabric passes about a roller brush for being pressed into the pins of the conventional tenter frame. The transition from the plane in which the static web decurler lies to the lower generally horizontal plane wherein the tenter chains are disposed, is performed by guiding the fabric in contact about the surface of a large rotating brush or roll covered with bristles which guides the fabric from the level of the static web decurler to the lower level of the tenter chains, while at the same time pressing the edge of the web onto the pins of the tenter chain. However, it has been found that the use of the large diameter rollers for assisting in the transition of the fabric from the level of the static decurler to the lower level wherein the fabric is impinged upon the pins of the tenter frame results in considerable distortion or stretching of the edges of the fabric.

Further, in feeding flimsy fabrics to tenters under low tension, the center of the fabric tends to sag and causes an increased tendency for the edges of this fabric to curl. It is necessary that the edges of the fabric be controlled from the decurler until they are engaged by the tenter chains to avoid their recurling after passing through the decurler.

SUMMARY OF THE INVENTION

The tenter frame in accordance with the teachings of the present invention guides the edges of the fabric through a static decurling device similar to that shown in U.S. Pat. No. 4,578,845 and directly onto the pins of the tenter chain with little or no deviation from the straight line, thereby avoiding distorting the edges of the fabric, or requiring excess force at the edges of the fabric to compensate for downward drape in the middle of the web.

The prior art is devoid of any teaching or suggestion of the above identified invention.

The static decurling device of the invention while similar to that shown in U.S. Pat. No. 4,578,845, differs therefrom in the way it is mounted and in the configuration of its plates. The static decurler of the invention comprises top and bottom plates, each of which has a first horizontal surface for supporting static polymeric decurling fins which cooperate with each other to decurl the fabric on one horizontal level, and a second horizontal extension which is on a different horizontal level for supporting the plates on a level which is equal to the rails of the tenter frame, while at the same time permitting the decurling working surfaces to be at a level which is lower than the horizontal plane of the tenter frame rail. By providing the working surfaces at a level which is, at least in part, lower than the level of the horizontal tenter frame rails, it is possible to provide much less distortion in the edges of the fabric transported to the tenter frame.

It is an object of the present invention to provide a tenter frame having an improved means for feeding fabric to the tenter pins.

It is an object of the present invention to provide a tenter frame with means for decurling the edges of the fabric and for guiding the edges of the fabric onto the pins of the tenter in an improved manner.

Another object of the present invention is to provide a tenter frame with an improved static decurling device for guiding the edges of the travelling fabric in a path which is substantially straight from the feed roll to the point at which the edges of the fabric are engaged by the pins of the tenter frame.

Yet another object of the present invention is to provide an improved tenter frame with a device for decurling the edges of the fabric which is readily adapted to pass both butt seams and overlapped or turned up seams through the decurling device without distorting the edges of the fabric.

Still another object of the present invention is to provide an improved static decurling device which decurls the edges of the fabric at a level lower than the horizontal plane of the tenter frame rails, thereby avoiding distorting the edges of the decurled fabric.

Generally speaking, the tenter of the present invention comprises a fabric supply such as a roll or the like, a guide or feed roll located with its upper periphery in a generally horizontal plane for guiding and feeding fabric to be treated on the tenter frame. After the fabric leaves the feed roll, it travels downwardly in a generally inclined path to the nip of a pair of nip rolls which lie in a horizontal plane which generally coincide with the horizontal plane of the tenter frame chains. Interposed between the feed roll and the nip rolls is a static decurling device of the general type, for example, as disclosed in U.S. Pat. Nos. 4,578,845; 4,068,789; or 4,217,682. The decurling device is mounted on an inclined bracket having an incline which substantially parallels, and coincides with, the inclination of the fabric passing from the feed roll to the nip rolls. The edge decurling device comprises a pair of plates, between which the edge of the fabric passes for uncurling the edges and for guiding the edges of the fabric into the nip formed between the nip rolls. The upper nip roll has a portion of its surface covered by a plurality of bristles which engage the edges of the fabric lightly after they leave, or substantially as they leave the static decurler in order to maintain the edges of said fabric in a flattened condition, and also to guide the fabric over the pins on each of the tenter chains. Alternatively, a brush roll is located adjacent the aforementioned roll to accomplish a like purpose. The bristles on the upper nip roll or brush serve to deflect or press the fabric onto the pins of the tenter chain with very little deflection or distortion between the edge of the fabric as it passes from the feed roll to the tenter chains for engagement therewith.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DETAILED DESCRIPTION OF THE DRAWINGS

Figure 1:
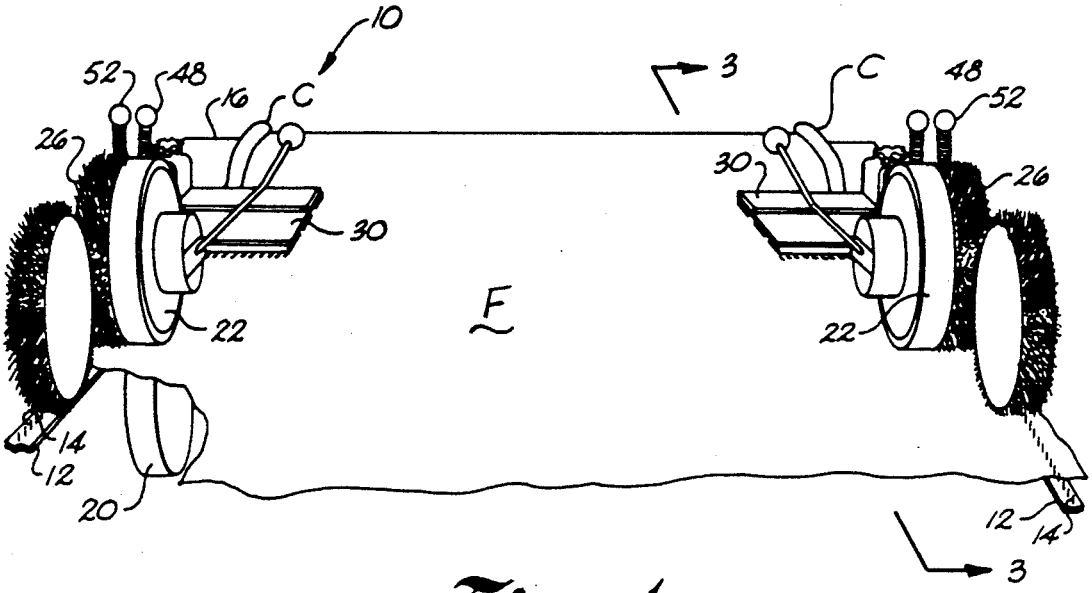
FIG. 1 is a top perspective view of a tenter frame of the invention showing a fabric guided through the decurling devices and onto the pins of the tenter chain, with parts broken away for clarity.

Referring now to FIGS. 1, 2, 3, 4, and 7 of the drawings, it will be seen that tenter frame 10 of the invention comprises a pair of tenter chains 12 having a plurality of pins 14 for engaging the edges of fabric F for transporting the fabric through the tenter frame for its normal intended purpose. It will also be noted in FIG. 1, that each of the edges of the fabric delivered from fabric supply (not seen) over guide roll 16 has its edge curled, folded or pleated as seen at C. It will also be noted that the upper periphery of roll 16 lies in a generally horizontal plane which is elevated over and is higher than the generally horizontal plane in which tenter chains 12 extend, and the fabric F is guided along an inclined path from the upper surface of roll 16 to a point where the fabric is nipped by bottom nip roll 20 in cooperation with top composite roll 22. It should be understood, however, that nip roll 20, though preferred, could be replaced with a conventional conveyor means (not shown). The nip between top roll 22 and bottom roll 20 occurs first above the top level of the pins 14. The nip defined between rolls 20 and 22 affords all overfeed capability for the tenter. The top composite roll 22 has two surfaces, one of which is a nip surface for cooperating with bottom nip roll 20 and the other of which is a brush surface 26 having bristles for forcing the fabric edge onto the pins 14 of the tenter chain 12. Composite roll 22 could, in fact, be two separate rolls as defined above.

Disposed between roll 16 and the nip formed between rolls 22 and 20, and supported by tenter frame rail 18, is a static decurling device 30 for decurling the edges C of the fabric before the edges C are brought into contact with the pins of the tenter frame chain 12. Edge decurler 30 is preferably a static decurler of the general type disclosed in U.S. Pat. No. 4,578,845 and is supported on an inclined support bracket, which, in turn, is supported on rail 18, at an angle which generally coincides with the incline of the fabric as it traverses from feed roll 16 to the nip between bottom nip roll 20 and upper composite roll 22, with little or no distortion or deflection of the fabric edge during its passage from feed roll 16 to the nip between the nip rolls 20 and 22.

Generally speaking in prior art structures, there is a significant drape of fabric between the edges as the fabric enters tenter frame 10. In fact, significant holding power is required of the rolls 20, 22 to compensate for said drape which is due to the angular change of fabric passing between roll 16 and nip rolls 20, 22. With the present invention, such excess forces are diminished, if not alleviated.

It will be noted that edge decurler 30 comprises a top plate 36 and a bottom plate 38. The top plate has a plurality of static decurling fins sections 42 composed of a polymeric material and the bottom plate has a plurality of bottom static decurling fins 40, also composed of a polymeric material, which cooperate with each other to remove curl from a fabric passing between said top and said bottom plate but without distorting the path of the edge of the fabric as it travels from the feed roll 16 to the nip defined between rolls 20 and 22.

Figure 2:
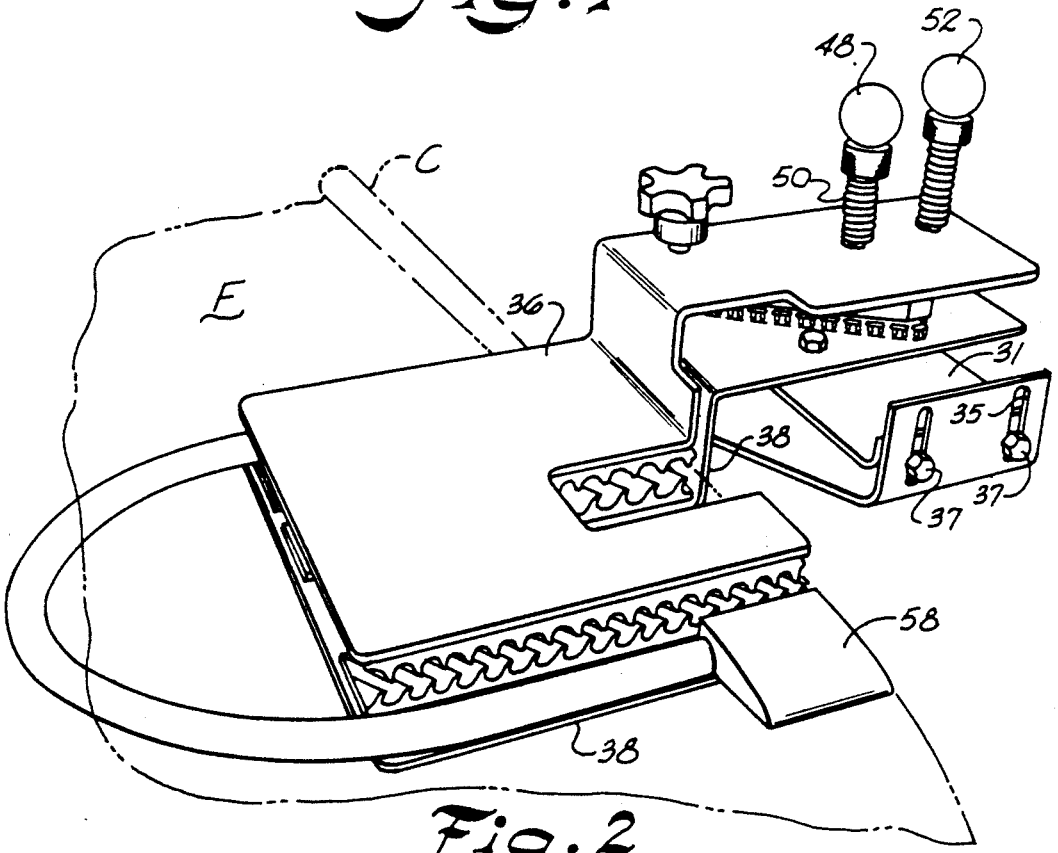
FIG. 2 is a perspective view of the static decurler of the invention.
Figure 3:
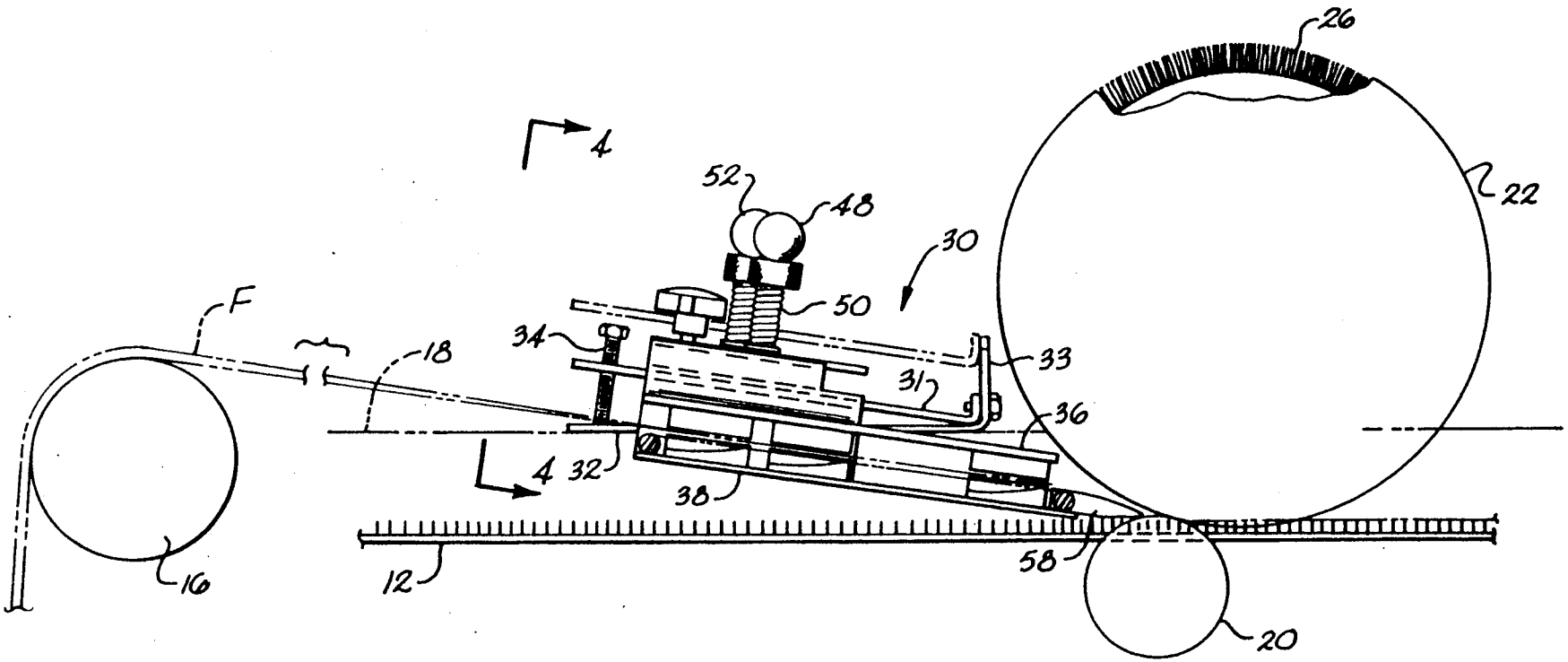
FIG. 3 is a schematic vertical cross-sectional view of the tenter frame of the invention taken along lines 3—3 of FIG. 1.
Figure 4:
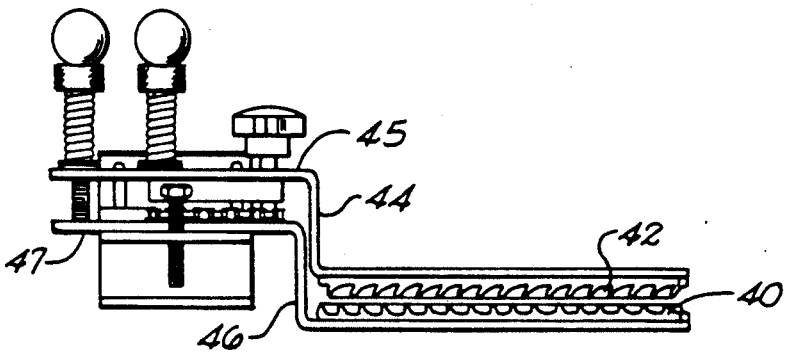
FIG. 4 is a schematic vertical cross-sectional view of the static decurling device of the invention, taken along lines 4—4 of FIG. 3.

Referring particularly now to FIGS. 2 and 4, it will be noted that the top plate 36 of decurler 30 has a vertical portion 44 which bridges the horizontal portion of plate 36 supporting the decurling fins and a horizontal extension 45 of plate 36. Likewise, bottom plate 38 has a vertical portion 46 which bridges the horizontal portion of plate 38 which supports the decurling fins 40 and a horizontal extension 47. Horizontal extension 47 is mounted upon and fixed to the upper inclined surface 33 of support bracket 32, as best seen in FIG. 3.

Top plate extension 45 is supported upon bottom plate extension 47 by a plurality of adjustable legs (not shown) such as those disclosed and illustrated in U.S. Pat. No. 4,578,845, which is incorporated herein by reference. The lengths of the support legs for the top plate are adjustable so as to maintain a predetermined orientation between the top plate 36 and the bottom plate 38 as shown in FIG. 2 and FIG. 4. Top plate 36 is forced or held against its support legs by means of a spring 50 which extends about a quick-release handle 48 for a quick release of the top plate of the static decurling device as disclosed and described in detail in U.S. Pat. No. 4,578,845. It should be pointed out, however, that decurlers as generally disclosed in commonly assigned U.S. Pat. Nos. 4,217,682, 4,322,026, and 4,447,937 would also be acceptable in the context of the present invention.

Figure 5:
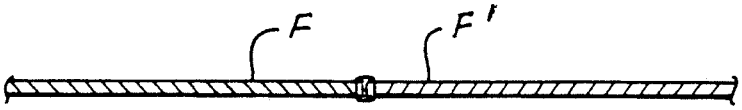
FIG. 5 is a cross-sectional view of the fabric showing a butt seam between two pieces of fabric.
Figure 6:
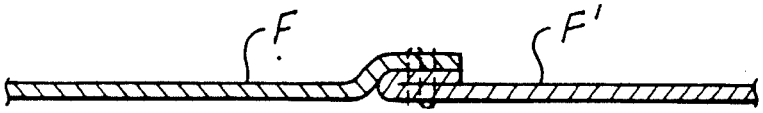
FIG. 6 is a view similar to that shown in FIG. 4, but illustrating an overlap or turned up seam joining two pieces of fabric.

In the edge decurling device of the invention there preferably is a pressure adjusting spring loaded screw 52 which is adapted to apply a counterforce on the outer or opposite edge of the top plate so as to partially relieve the pressure exerted by top plate 36 at the point the fabric passes between said top and bottom plates 36 and 38. This permits the static decurling device to accommodate a variety of fabric seams wherein two pieces of fabric F and F' are sewn together in a butt seam as shown in FIG. 5 or in a turned up seam or overlap seam 56 as shown in FIG. 6, without becoming entangled, ensnared or inadvertently laterally displaced by decurling device 30 which could result in distortion or rupturing of the fabric edge or dislodging the fabric edge from its engagement with the pins 14 of tenter frame chains 12.

Figure 7:
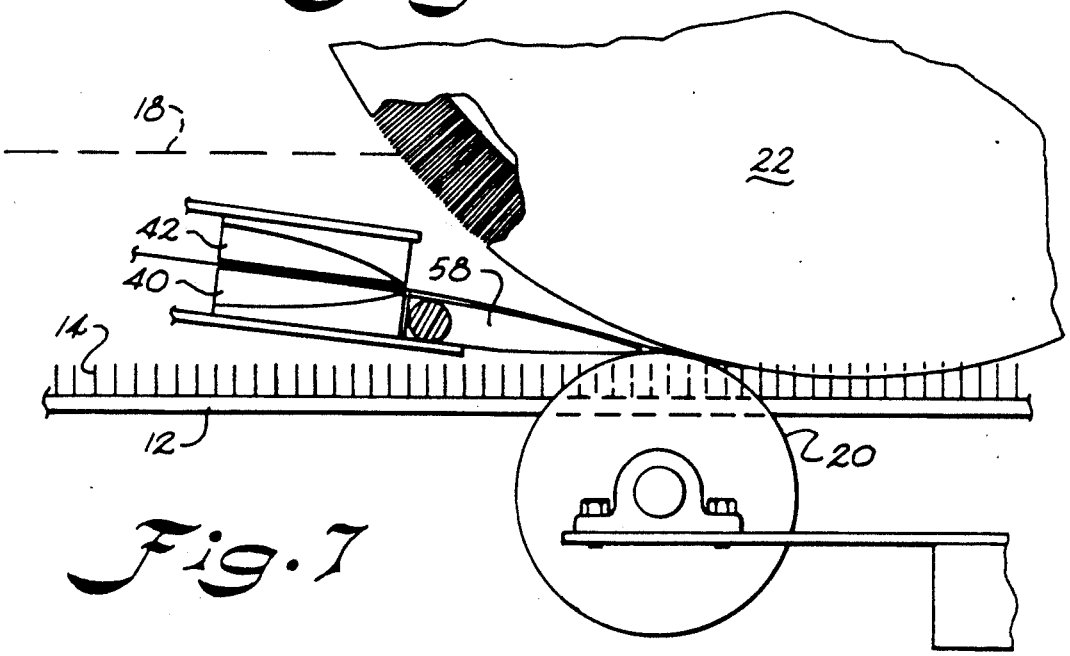
FIG. 7 is an enlarged view showing a portion of the decurling device, the arcuate plate or guide and the nip rolls similar to that shown in FIG. 3.

Referring now to FIGS. 2 and 4, in particular it will be noted that by having the top and bottom plates mounting portions 45 and 47 extend on a horizontal level which is elevated over the level of the portion of the top and bottom plates which support the static decurling fins 40 and 42, permits the decurling device and its support bracket to be mounted on horizontal surface of rail 18 as seen in FIG. 3, at a plane which is higher than the horizontal plane of tenter chains 12. The vertical portions 44 and 46 permits the static decurling device 30 to engage the fabric F at a point which is below the level of the tenter frame rail 18 and to decurl the fabric edge without substantial deviation of the edge from the inclined path over roll 16 to the nip point between rolls 20 and 22, as best seen in FIGS. 3 and 7.

It will also be noted that bracket 32 comprises a horizontal surface which is supported on tenter frame rail 18 and has bolted thereto an inclined surface 31 which is supported at an adjustable level by means of vertical slots 35 and holding bolts 37. The degree of inclination is adjustable by adjusting jack bolt 34 to fine tune the inclination of the static decurling device to the level of the fabric passage from roll 16 to the nip between rolls 20 and 22.

Pressure adjusting screw 52 thus permits fine adjustment against the force exerted by the top plate 36, to assure passage of fabric seams therethrough while still maintaining control of the edge portion of even the most flimsy knit fabric while properly guiding the fabric edge onto the pins 14 of tenter frame chain 12. It will also be noted that the stationary arcuate plate 58 is supported so as to bridge the distance between the decurling device 30 and the nip between the upper and lower nip rolls 22 and 20 to further support the fabric edge without distortion right up to the nipping point.

Stationary arcuate plate 58 has its upper surfaces curved downwards toward said nip rolls and its curvature tends to maintain the edge of said fabric flat without undue stretching of said edge. Its curvature is only sufficient to maintain a slight arc in the edge as it moves from said decurler to said nip rolls.

It will also be noted that the inclination and the level of the upper surface inclined support bracket 32 is adjustable by means of a bolt 34 which passes through the inclined top plate 31 and the generally horizontal bottom plate of the bracket so as to vary the degree of inclination of the static decurling device to at least generally correspond to the inclined path of the fabric travelling from the feed roll 16 to the nip between rolls 20 and 22.

While a feed roll 16 has been defined above, obviously some could be remote from tenter 10 with roll 16 being instead an idler or driven guide roll.

Having described the present invention in detail, it is obvious that one skilled in the art will be able to make variations and modifications therein without departing from the scope of the present invention. Accordingly, the scope of the present invention will be determined only by the scope of the claims appended hereto.

What I claim is:

1. A tenter frame for spreading and transporting open widths of a moving fabric comprising:

a) a pair of endless tenter chains, each of which has a plurality of pins for engaging an edge of said fabric for transporting said fabric through said tenter, said tenter chains being supported for moving said fabric through a first generally horizontal plane;

b) means to supply fabric to one end of said tenter frame over a roll, an upper peripheral surface of which is disposed in a second generally horizontal plane that is higher than said first horizontal plane;

c) static decurling means disposed on each side of said tenter frame, between said tenter chains and said roll, on an inclined plane which intersects said first plane and said second plane, for engaging each edge of said moving fabric to remove curl or folds from said edges of said fabric;

d) nip means forming a nip substantially in said first plane immediately adjacent an exit end of said decurling means and before said edges of said fabric are engaged by said pins for receiving said fabric after said edges have passed through said decurling means and maintaining said fabric edges in said flattened state; and e) rotary means disposed adjacent an end of each of said tenter chains and adjacent to said nip means, said rotary means engaging each edge of said fabric and pressing said edges into holding engagement with the pins of each of said tenter chains.

2. A tenter frame as set forth in claim 1, wherein said static decurling means is disposed on a bracket, one surface of which extends on an inclined plane which intersects with the first plane and said second plane.

3. A tenter frame as set forth in claim 2, wherein the degree of incline in said supporting bracket is adjustable.

4. A tenter frame as set forth in claim 1, wherein each decurler means comprises a top plate and a bottom plate.

5. A tenter frame as set forth in claim 4, wherein fins are disposed in a plurality of sections which cooperate with each other and which engage the opposite sides of said moving fabric for decurling said edges.

6. A tenter frame as set forth in claim 4, wherein said top plate is spring loaded towards said bottom plate and is maintained a predetermined distance from said plate.

7. A tenter frame as set forth in claim 6 wherein the spacing between said top plate and said bottom plate is adjustable.

8. A tenter frame as set forth in claim 6, wherein means are provided for partially offsetting the pressure exerted by said spring on said top plate at the point where said plate contacts the upper surface of the fabric.

9. A tenter frame as set forth in claim 4, wherein each of said top and bottom plates have a plurality of banks of fins associated therewith, at least one of said banks of fins adjacent the fabric entrance to said decurler having a predetermined vertical spacing between opposed fins while at least one of the other banks of fins is provided with a lesser space between opposed fins.

10. A tenter frame as set forth in claim 6, wherein said fins of the top and bottom plates of said static decurling device are held at a predetermined relative spacing.

11. A method of mounting a fabric in a tenter frame, comprising the steps of:

a) supplying a fabric;

b) transporting said fabric along a first path to a point in a first plane;

c) deflecting said fabric into a second path from said first path and transporting said fabric along said second path which is at an angle to said first path and which extends at least approximately in a straight line;

d) deflecting said fabric from said second path along a third path which extends in a substantially different line from said second path;

e) decurling each of the edges of said fabric as it moves through said second path without causing said edges to deviate from said path substantially, said decurling taking place adjacent the point where said fabric is deflected from said second path; and f) nipping said fabric between opposing surfaces just prior to said fabric being pressed onto said pins;

g) pressing the edges of said fabric onto pins carried by moving chains of said tenter frame.

12. The method as set forth in claim 11, wherein the edges of the fabric are decurled by a static decurling device.

13. A method as set forth in claim 11, wherein said third path is substantially horizontal and is located in a plane which is lower than the point where said first path and second path intersect.

14. A method as set forth in claim 13 wherein said fabric is deflected from said first path and guided into said second path by means of a feed roll.

15. A method as set forth in claim 13 wherein said fabric is deflected from said second path into said third path by means of said opposing nipping surfaces which comprises a pair of nip rolls.

16. A tenter frame for spreading and transporting open widths of a moving fabric, comprising:

a) a pair of endless tenter chains, each of which has means for engaging an edge of said fabric for transporting said fabric through a first generally horizontal plane;

b) means to supply fabric to one end of said tenter frame in a second generally horizontal plane which is higher than said first horizontal plane;

c) decurling means disposed on each side of said tenter frame, between said fabric supply means and said tenter chains, on an inclined plane which intersects said first and second horizontal planes, for engaging each edge of said moving fabric to remove curl, folds, or pleats from said edges while guiding said fabric towards said tenter chains;

d) nip means disposed in said first horizontal plane adjacent to said decurling means for engaging each edge of said fabric after said edges have passed through said decurling means, and for maintaining said edges in a flattened, uncurled condition; and e) means for engaging and pressing the edges of said fabric into engagement with the pins of said tenter chains.

17. A tenter frame as set forth in claim 16, wherein said decurling means are static.

18. A tenter frame as set forth in claim 17, wherein each decurler means comprises a top plate and a bottom plate.

19. A tenter frame as set forth in claim 18, wherein fins are disposed in a plurality of sections which cooperate with each other and which engage the opposite sides of said moving fabric for decurling said edges.

20. A tenter frame as set forth in claim 18, wherein said top plate is spring loaded towards said bottom plate and is maintained a predetermined distance from said plate.

21. A tenter frame as set forth in claim 20 wherein the spacing between said top plate and said bottom plate is adjustable.

22. A tenter frame as set forth in claim 20, wherein means are provided for partially offsetting the pressure exerted by said spring on said top plate at the point where said plate contacts the upper surface of the fabric.

23. A device as set forth in claim 21, wherein a fine-tuning means comprises a spring loaded bolt disposed adjacent the outer end of said second portions for drawing said top and bottom plates together to offset the force said spring exerts on the first portion of said top plate.

* * * * *